US008029198B2

(12) United States Patent
Ko

(10) Patent No.: US 8,029,198 B2
(45) Date of Patent: Oct. 4, 2011

(54) ACTUATION MECHANISM HAVING TWO DEGREES OF FREEDOM AND SENTRY ROBOT HAVING THE SAME

(75) Inventor: Jun-yeoul Ko, Changwon-si (KR)

(73) Assignee: Samsung Techwin Co., Ltd., Changwon (KR)

( * ) Notice: Subject to any disclaimer, the term of this patent is extended or adjusted under 35 U.S.C. 154(b) by 1255 days.

(21) Appl. No.: 11/711,423

(22) Filed: Feb. 27, 2007

(65) Prior Publication Data

US 2007/0209501 A1 Sep. 13, 2007

(30) Foreign Application Priority Data

Mar. 3, 2006 (KR) ..... 10-2006-0020411

(51) Int. Cl.
*G03B 17/00* (2006.01)

(52) U.S. Cl. ..... 396/427; 89/40.01

(58) Field of Classification Search ..... 396/427; 89/37.01, 37.17, 40.01, 41.09, 41.05
See application file for complete search history.

(56) References Cited

U.S. PATENT DOCUMENTS

| | | | | |
|---|---|---|---|---|
| 5,379,676 | A | 1/1995 | Profeta et al. | |
| 5,974,272 | A * | 10/1999 | Kiesow et al. | 396/140 |
| 6,302,010 | B1 * | 10/2001 | Holler | 296/187.07 |
| 6,499,382 | B1 * | 12/2002 | Lougheed et al. | 89/41.05 |
| 6,997,173 | B2 * | 2/2006 | MacDougall | 124/3 |
| 2006/0039687 | A1 * | 2/2006 | Yang et al. | 396/20 |
| 2006/0216019 | A1 * | 9/2006 | Thompson | 396/427 |
| 2007/0019106 | A1 * | 1/2007 | Ibaraki | 348/373 |
| 2007/0036540 | A1 * | 2/2007 | Nama et al. | 396/427 |

FOREIGN PATENT DOCUMENTS

KR 1020030089184 A * 5/2005

OTHER PUBLICATIONS

Machine translation of KR 10-2003-0089184, Jun. 2005.*

* cited by examiner

*Primary Examiner* — Clayton E Laballe
*Assistant Examiner* — Linda Smith
(74) *Attorney, Agent, or Firm* — Drinker Biddle & Reath LLP

(57) ABSTRACT

Provided are an actuation mechanism having two degrees of freedom of movement and a sentry robot having the actuation mechanism having two degrees of freedom of movement capable of performing wide and narrow monitoring and sentry in short and long ranges and automatically shooting at a target. The actuation mechanism having two degrees of freedom includes a pivot driving portion and a vertical driving portion. The pivot driving portion includes a platform, a vertical driving portion connection portion rotatably installed on the platform, and a pivot driving portion including a motor which rotates the vertical driving portion connection portion. The vertical driving portion includes a pivot driving portion connection portion connected to an upper side of the vertical driving portion connection portion, a column standing on the pivot driving portion connection portion, a mount rotatably arranged in an upper portion of the column, and a motor rotating the mount with respect to the column. The rotation shaft of the vertical driving portion connection portion of the pivot driving portion and the rotation shaft of the vertical driving portion mount intersect each other.

24 Claims, 6 Drawing Sheets

ACTUATION MECHANISM HAVING TWO DEGREES OF FREEDOM AND SENTRY ROBOT HAVING THE SAME

CROSS-REFERENCE TO RELATED PATENT APPLICATIONS

This application claims the benefit of Korean Patent Application No. 10-2006-0020411, filed on Mar. 3, 2006, in the Korean Intellectual Property Office, the disclosure of which is incorporated herein in its entirety by reference.

BACKGROUND OF THE INVENTION

1. Field of the Invention

The present invention relates to an actuation mechanism having two degrees of freedom of movement and a sentry robot having the same, and more particularly, to an actuation mechanism having two degrees of freedom that is capable of tracking a target with a camera and/or gun, and a sentry robot having the actuation mechanism having two degrees of freedom capable of performing wide and narrow monitoring in short and long ranges and automatically shooting at a target.

2. Description of the Related Art

Intelligent robot technology is one of the next generation new technologies which will lead the 21$^{st}$ century's industrial and military science technologies with the technical development of artificial intelligence (AI). In particular, a monitoring and sentry system is a sophisticated system employing a variety of technologies such as ultra-low brightness camera technology, image recognition technology, image processing and storing technology, voice recognition technology, servo technology, image tracking technology, and system control technology.

As the security industry grows rapidly, the demands for the use of intelligent monitoring and sentry robot systems in important national facilities such as airports, harbors, and nuclear power plants will increase. In the military, such a system enhances the efficiency of the sentry function in peace time. To efficiently improve the security of solders in war time, various unmanned equipment, which can replace 3D (dangerous, dirty, dull) duties of solders, have been developed and deployed. The unmanned robot based on the AI technology can efficiently replace manpower and greatly enhance military competitive power.

In particular, the monitoring and sentry robot can perform the most important role in the development of the military strategy. Also, in terms of monitoring and sentry functions, the use of robots can prevent the fatigue and loss of concentration caused by repetition of tasks by solders on sentry duty. Furthermore, the system can have accurate tracking and instant reaction abilities including high speed and accurate shooting ability during engagement with weapons during war time.

U.S. Pat. No. 5,379,676 entitled "Fire Control System" discloses a shooting control system for a manually aimed gun. In the patent, a target is tracked by a video tracker and laser of an electro-optical device (EOD) and the distance and direction of the target are calculated. The image of target is sent to a video monitor of an operator and the operator performs shooting by controlling the gun to track the target through the video monitor.

However, the shooting control system has a problem in that the range of monitoring by a camera device of the system is limited. Also, the conventional monitoring and sentry system employing a single video camera or common monitoring camera is a basic system adopting the concept of automation, not a system capable of intelligently recognizing a target and automatically tracking the target.

In particular, the conventional actuation mechanism included in a monitoring and sentry system has a problem in that the movement of a mechanism driving a camera or gun to track a target is so limited that accurate tracking of the target is difficult. Thus, an actuation mechanism capable of solving the problem, and a sentry robot having the actuation mechanism, are needed.

SUMMARY OF THE INVENTION

To solve the above and/or other problems, the present invention provides an actuation mechanism of a camera and/or gun capable of accurate tracking of a target.

Also, the present invention provides a sentry robot having an actuation mechanism capable of performing monitoring and sentry functions, wide and narrow monitoring in short and long ranges, and automatically shooting at a target.

According to an aspect of the present invention, an actuation mechanism having two degrees of freedom of movement comprises a pivot driving portion comprising a platform, a vertical driving portion connection portion rotatably installed on the platform, and a pivot driving portion including a motor which rotates the vertical driving portion connection portion, and a vertical driving portion comprising a pivot driving portion connection portion connected to an upper side of the vertical driving portion connection portion, a column standing on the pivot driving portion connection portion, a mount rotatably arranged in an upper portion of the column, and a motor rotating the mount with respect to the column, wherein a rotation shaft of the vertical driving portion connection portion of the pivot driving portion and a rotation shaft of the vertical driving portion mount intersect each other.

According to another aspect of the present invention, a sentry robot comprises a base, a main body installed on the base capable of pivoting, a master camera capable of rotating with the main body, the above-mentioned actuation mechanism having two degrees of freedom arranged on the main body, and an active camera arranged capable of moving along with the motion of the actuation mechanism having two degrees of freedom.

The master camera comprises two cameras, each installed at both sides of the main body.

The sentry robot further comprises a gun installed on the main body with the active camera pointing in a direction in which the active camera points and capable of moving with the active camera while tracking a target.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
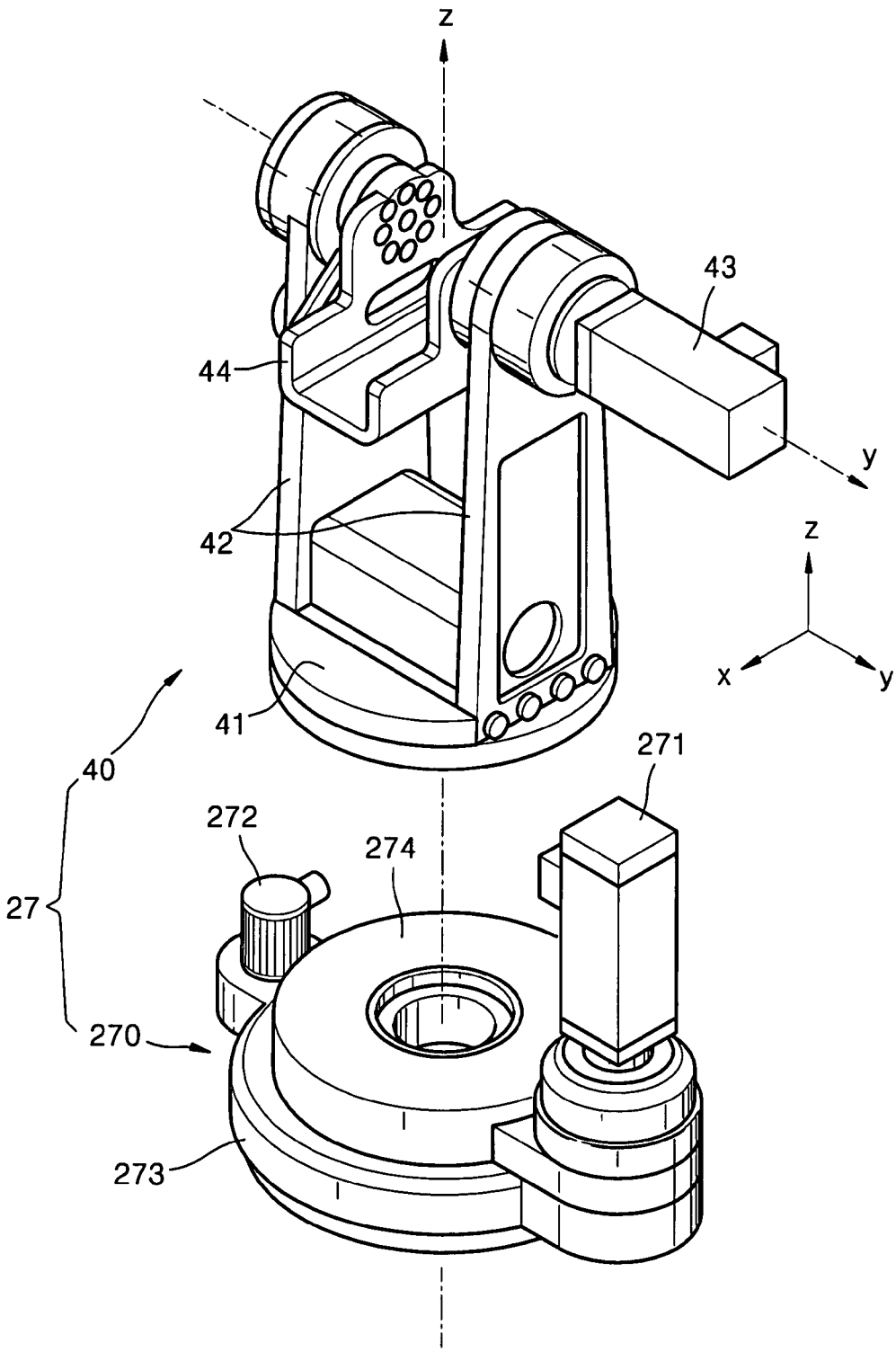
FIG. 1 is an exploded perspective view of an actuation mechanism having two degrees of freedom according to an embodiment of the present invention.

FIG. 1 is an exploded perspective view of an actuation mechanism having two degrees of freedom of movement according to an embodiment of the present invention. As shown in FIG. 1, an actuation mechanism 27 having two degrees of freedom includes a pivot driving portion 270 and a vertical driving portion 40. The pivot driving portion 270 accommodates the vertical driving portion 40 of the upper portion of the actuation mechanism 27, and drives the vertical driving portion 40 to rotate in the left and right directions around a z-axis.

The pivot driving portion 270 includes a platform 273, a vertical driving portion connection portion 274, and a drive motor 271. The platform 273 is arranged at the lowermost portion of the pivot driving portion 270 and the vertical driving portion connection portion 274 is rotatably installed on the platform 273. A drive gear (not shown) is installed at one side of the platform 273 and a driven gear (not shown) engaged with the drive gear is installed at the vertical driving portion connection portion 274. The drive motor 271 rotates the drive gear to rotate the vertical driving portion connection portion 274 in the left and right directions. An encoder 272 can be further installed at the driven gear to detect the rotation angle of the driven gear.

The vertical driving portion 40 includes a pivot driving portion connection portion 41, a column 42, a mount 44, and a drive motor 43. The pivot driving portion connection portion 41 is coupled to the vertical driving portion connection portion 274 of the pivot driving portion 270. The column 42 stands on the pivot driving portion connection portion 41. The mount 44 is installed in the upper portion of the column 42 capable of vertically rotating around a y-axis. Preferably, two columns 42 fixedly stand on the pivot driving portion connection portion 41 at a predetermined interval. The mount 44 is located between the columns 42. A gun (not shown) and/or a camera (not shown) can be arranged on the mount 44 as necessary. The drive motor 43 is arranged in the upper portion of the column 42 to allow the mount 44 to vertically rotate with respect to the column 42. Preferably, a rotation shaft (not shown) of the drive motor 43 and a rotation shaft (not shown) of a coupling portion (not shown) between the mount 44 and the column 42 are arranged in a line.

Figure 2:
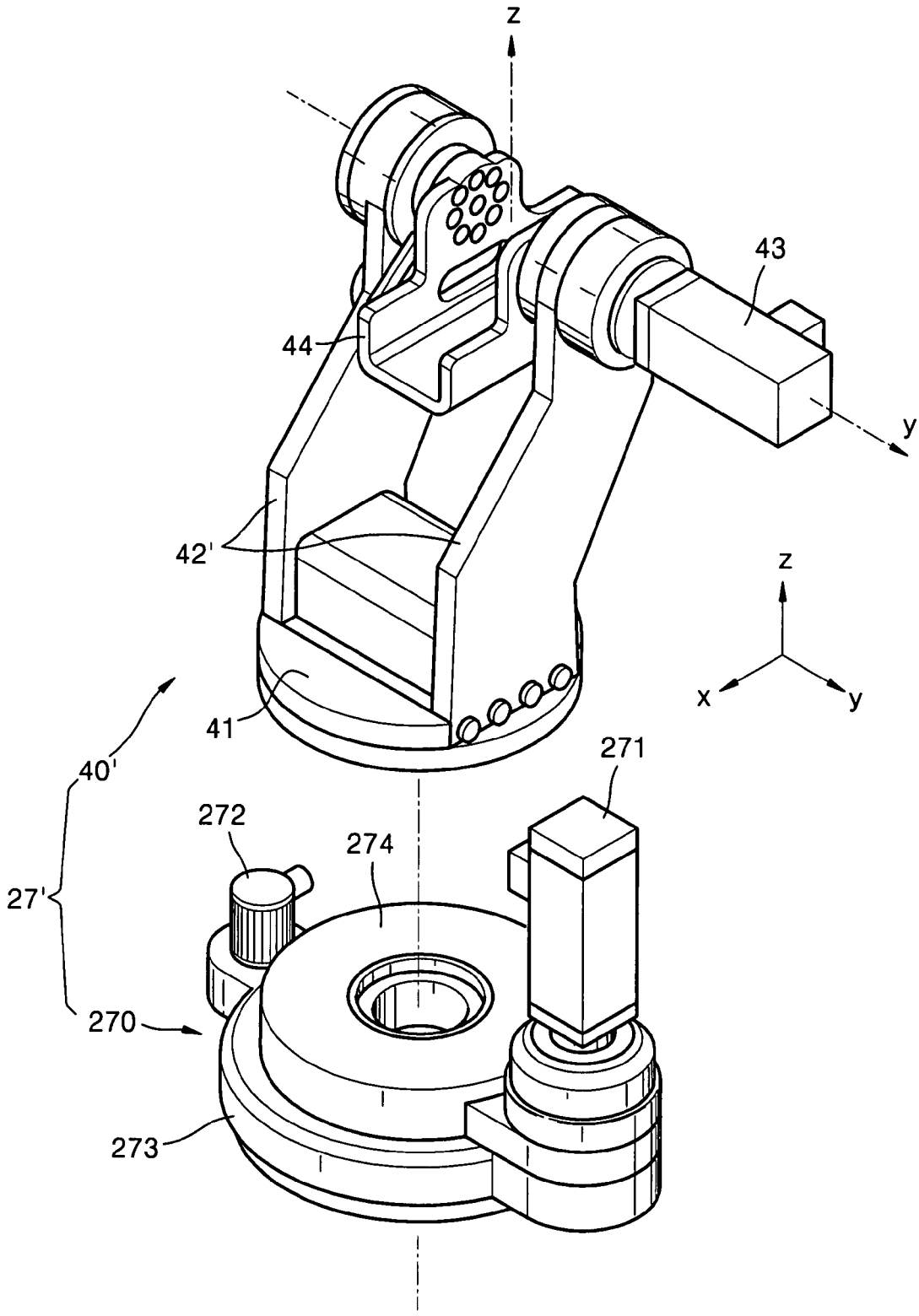
FIG. 2 illustrates a modified example of the actuation mechanism having two degrees of freedom of FIG. 1.

FIG. 2 illustrates a modified example of the actuation mechanism having two degrees of freedom of FIG. 1. The difference between the actuation mechanism having two degrees of freedom of FIG. 1 and that of FIG. 2 is in the shape of column. In the present embodiment, the shape of a column 42' is determined in consideration of the mount 44 supported by the column 42' and the weight and center of gravity of a member mounted on the mount 44. For example, when the gun is mounted on the mount 44, the gun is arranged such that the center of gravity of the gun is located around the upper end portion of the column 42', which is preferable in the control of the position of the gun. However, the center of the gravity of the gun is typically located at the rear side with respect to the overall length of the gun. Thus, in the sentry robot having the actuation mechanism having two degrees of freedom, a gunbarrel of the gun unavoidably protrudes too much from the front side of the robot. However, to protect the gunbarrel of the gun from bullets or debris, it is not preferable that the gunbarrel of the gun protrudes too much from the front side of the robot. Therefore, it is preferable to make the shape of the column 42' bent backward in order to secure the safety of the robot and maintain the function of the robot in an extreme situation such as war time.

Figure 3:
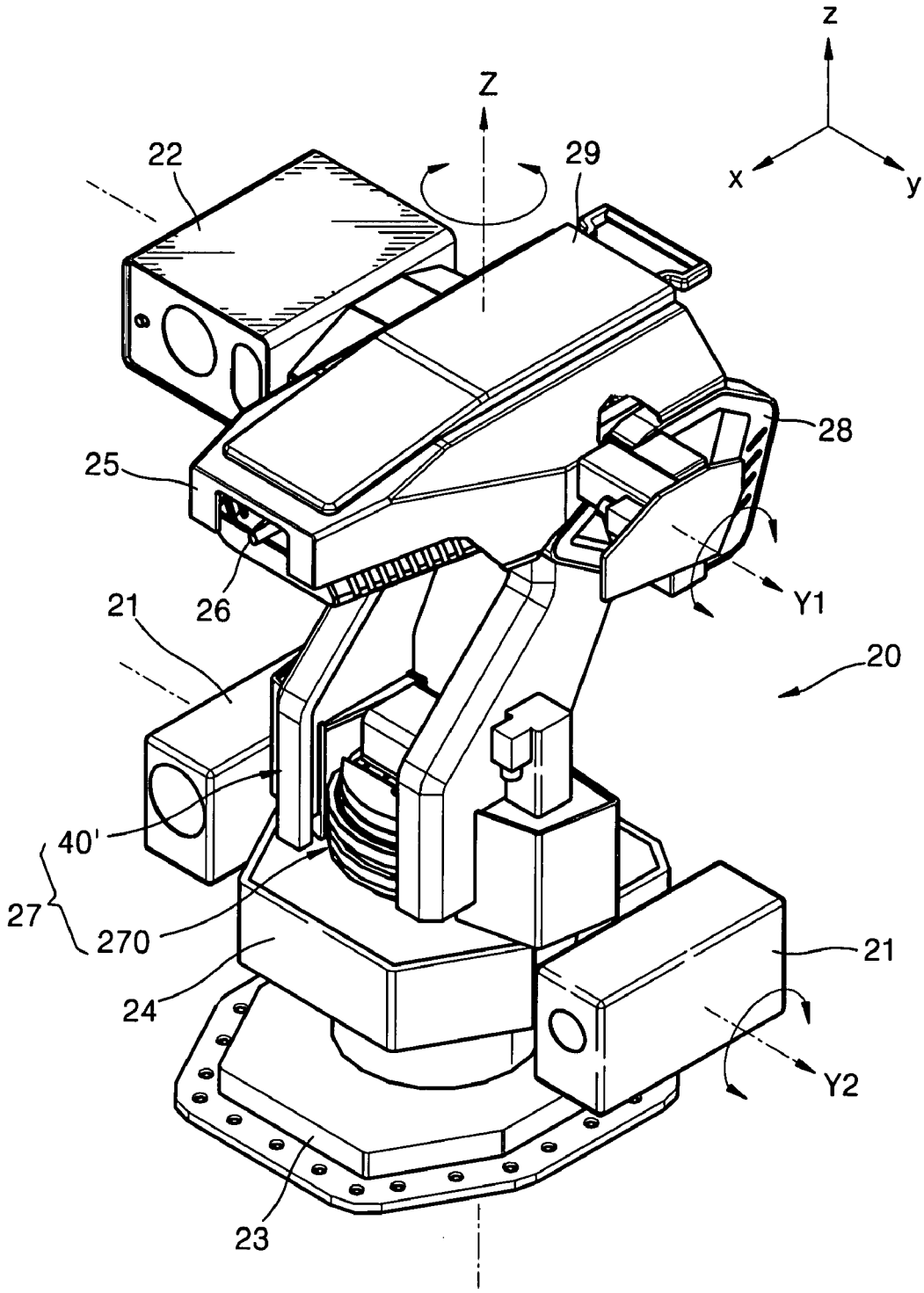
FIG. 3 is a perspective view showing the structure of a sentry robot according to an embodiment of the present invention.
Figure 4:
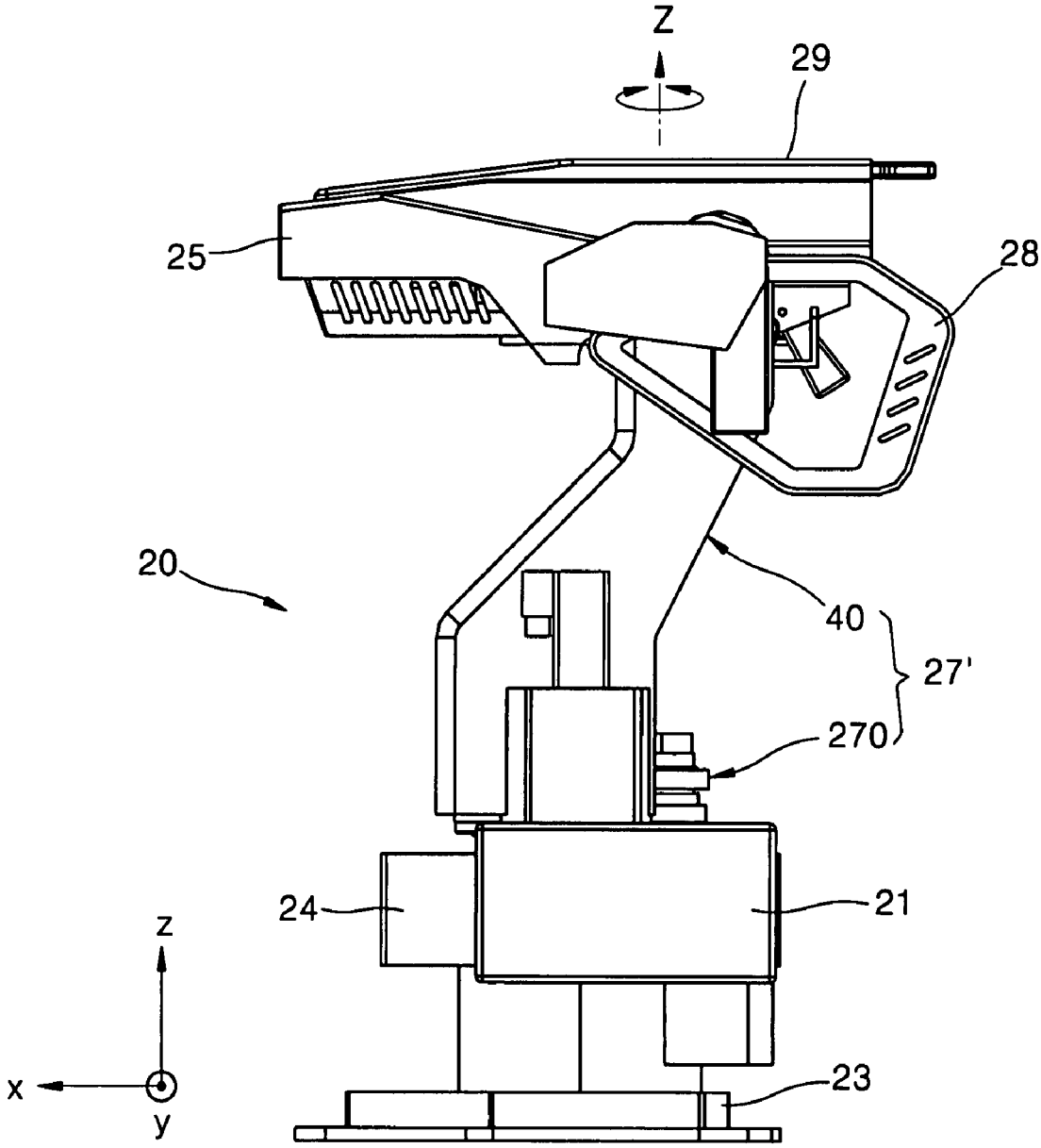
FIG. 4 is a side view of the sentry robot of FIG. 3.

FIG. 3 is a perspective view showing the structure of a sentry robot according to an embodiment of the present invention. FIG. 4 is a side view of the sentry robot of FIG. 3. Referring to FIGS. 3 and 4, a sentry robot 20 according to an embodiment of the present invention includes a base 23, an image monitoring portion, and an image tracking portion.

The base 23 is a member for fixedly installing the sentry robot 20 at a particular position or device. The image monitoring portion comprises a main body 24 arranged on the base 23, a master camera 21 and an image monitoring portion driving portion (not shown). The image tracking portion comprises a gun 26, an actuation mechanism 27' having two degrees of freedom, and an active camera 22 disposed on the actuation mechanism 27'.

The sentry robot 20 is operated by two types of cameras, that is, the master camera 21 and the active camera 22. The sentry robot 20 receives information on the movement of a target from each of the cameras and performs tracking for monitoring and sentry so that a tracking rate and a recognition rate are improved.

The main body 24 is capable of pivoting, and is capable of rotating to the left and right sides (panning) around a z-axis on the base 23. The master camera 21 is installed on the main body 24. The gun 26 is installed with the active camera 22, as necessary. Armor to protect the robot from bullets or debris is preferably installed outside the main body 24.

The master camera 21 is installed on the main body 24, or at both sides of the main body 24 as shown in the drawings, and recognizes a target from an input image. The master camera 21 is rotatable around an y2-axis in a vertical direction with respect to the main body 24. The active camera 22 is mounted on a mount (not shown) of the actuation mechanism 27' having two degrees of freedom. The active camera 22 is installed capable of tilting and panning with respect to the main body 24 and tracking the target.

The gun 26 capable of shooting bullets, automatically or manually, at an enemy target is arranged in the upper portion of the actuation mechanism 27' in addition to the active camera 22. The actuation mechanism 27' having two degrees of freedom, which allows the active camera 22 and the gun 26 to move while tracking the target, is installed on the upper portion of the main body 24.

The actuation mechanism 27' having two degrees of freedom can rotate the active camera 22 and the gun 26 to the left and right sides around the z-axis and simultaneously up and down around an y1-axis with respect to the main body 24. A shooting driving portion (not shown) that allows the gun 26 to automatically or manually shoot is installed at the gun 26.

The sentry robot 20 according to the present embodiment may further include a control portion (not shown). The control portion receives an image from the master camera 21 and the active camera 22, recognizes the received image, and controls the operation of the master camera 21, the active camera 22, and a driving portion (not shown). The control portion may be installed inside the main body 24.

A gun armor 25 is preferably installed outside the gun 26 of the robot 20 to protect the gun 26 from bullets or debris coming from the outside. The gun armor 25 preferably includes a gun cover 29 which can be opened and closed, by an operator, to check the state of the gun 26. Also, a gun manual control handle 28 can be further installed to directly control the gun 26 by the operator as necessary.

Considering that a target has a certain size, not being a point, it is preferable that a gunbarrel of the gun 26 is parallel to the optical axis of the active camera 22 so that the direction of the gunbarrel of the gun 26, when pointing to a target, matches the direction of the active camera 22. The master camera 21 and the active camera 22 are preferably ultra-low brightness cameras having an infrared block filter that blocks the input of an image in an infrared area. The master camera 21 and the active camera 22 can receive a color image by turning on the infrared block filter during the day time, and a black and white image by turning off the infrared block filter during the night time. Accordingly, the master camera 21 and the active camera 22 can receive an image during the day time and the night time using the ultra-low brightness camera.

The master camera 21 preferably has a wider viewing angle than the active camera 22. That is, the master camera 21 with a wider viewing angle performs a function of detecting an overall movement in a main viewing range. The master camera 21 has a zoom function and is set by adjusting a magnification ratio according to the conditions in use such as the observation distance and range. The master camera 21 recognizes a target by acquiring an image from a wide area in the main viewing range, and detects an overall movement of the target.

The movement of the active camera 22 is controlled according to information on the movement of a target recognized by the master camera 21 so that the optical axis of the active camera 22 is directed to the center of the target. Also, the active camera 22 more accurately detects information such as the speed, displacement, and the size of a target that moves, because it maintains a higher resolution compared to the master camera 21.

For this purpose, the active camera 22 has the functions of zooming, panning, and tilting. The panning and tilting functions of the active camera 22 enable the optical axis of the active camera 22 to always point to the center of the target. Also, the image of the target can be enlarged by the zooming function of the active camera 22 so that the target can be observed in more detail.

Accordingly, given that the target has a certain size, since the direction of the gun barrel of the gun 26 is fixedly installed with respect to the active camera 22 it substantially matches the center axis of the active camera 22 pointing to the target, and the gun barrel of the gun 26 also points to the target.

Figure 5:
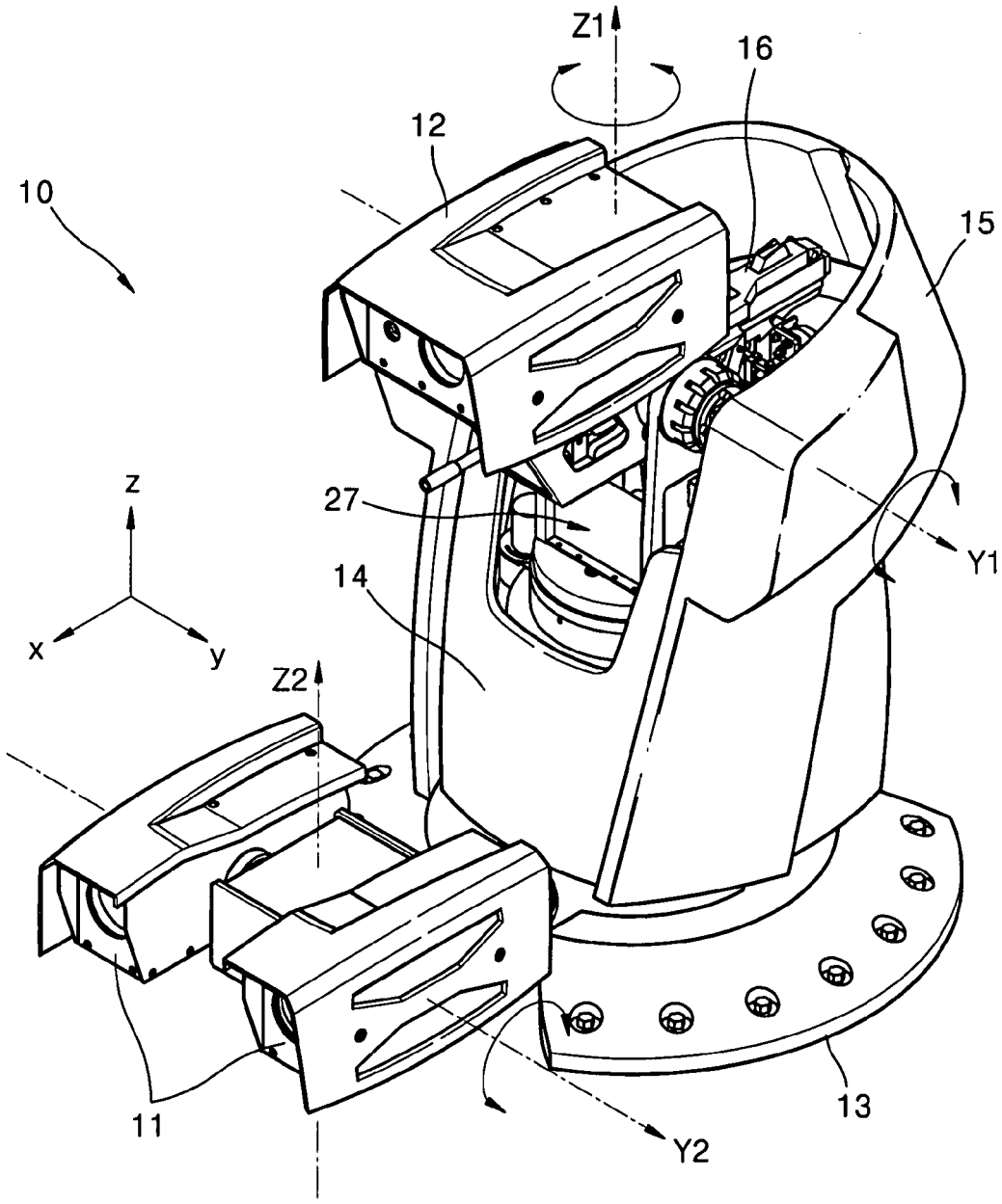
FIG. 5 is a perspective view showing the structure of a sentry robot according to another embodiment of the present invention.
Figure 6:
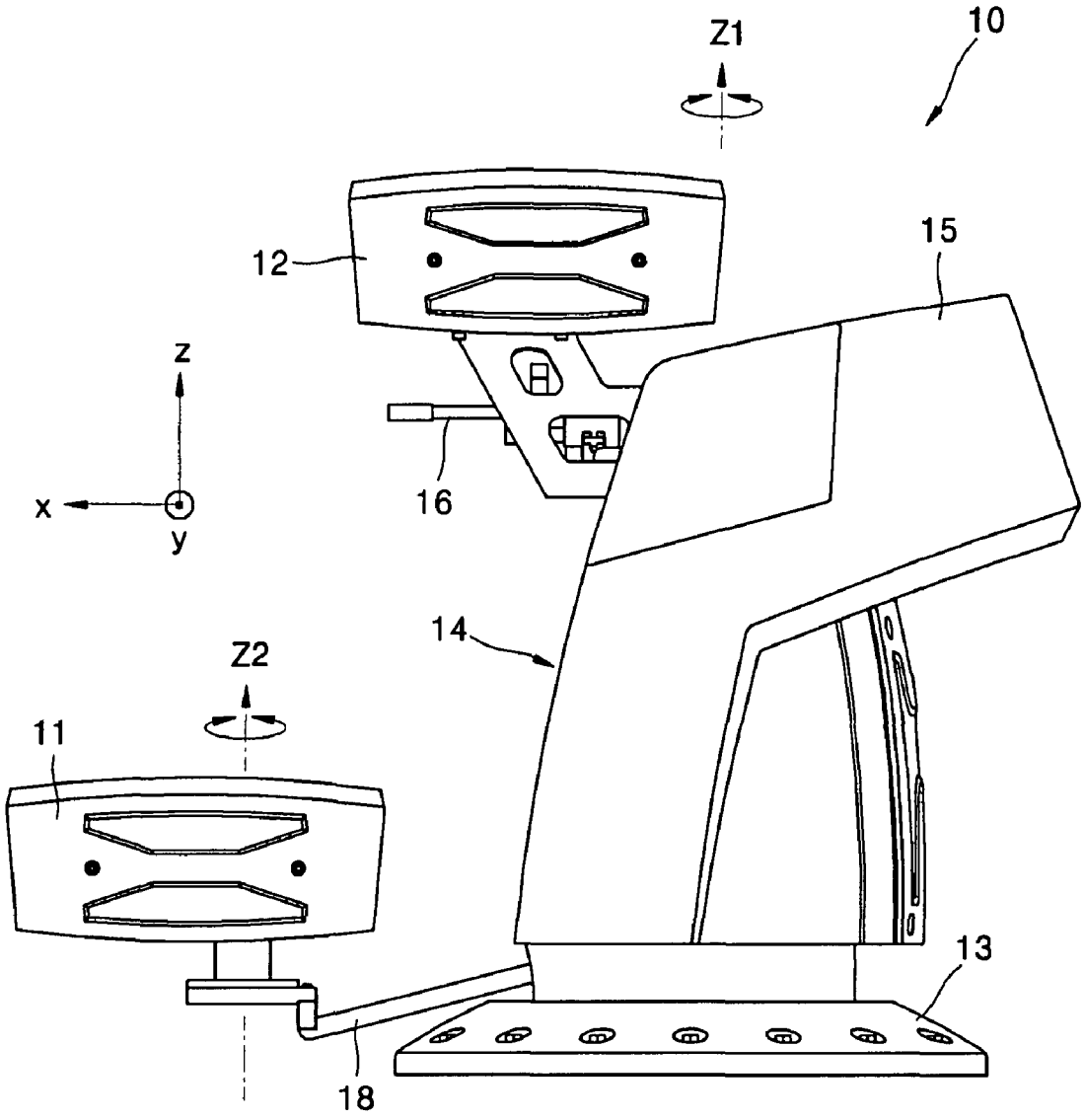
FIG. 6 is a side view of the sentry robot of FIG. 5.

FIG. 5 is a perspective view showing the structure of a sentry robot according to another embodiment of the present invention. FIG. 6 is a side view of the sentry robot of FIG. 5. Referring to FIGS. 5 and 6, a sentry robot 10 according to another embodiment of the present invention includes a base 13, a main body 14, a master camera 11, and an active camera 12. Like the above-described embodiment, the sentry robot 10 according to the present embodiment is operated by two types of cameras, that is, the master camera 11 and the active camera 12. The sentry robot 10 receives information on the movement of a target from each of the cameras and performs monitoring and tracking for the sentry function so that a tracking rate and a recognition rate are improved. The difference from the above-described embodiment is that the master camera 11 is arranged to protrude forward from the main body 14.

The master camera 11 is connected to the main body 14 by a frame 18 and recognizes a target from an input image. The main body 14 is rotatably coupled to the base 13 and rotates to the left and right directions around a z1-axis. Accordingly, the frame 18 and the master camera 11 can pivot in the left and right directions around the z1-axis. Also, the master camera 11 is installed capable of rotating in the left and right directions around a z2-axis and in the up and down directions around a y2-axis with respect to the frame 18.

The active camera 12 is capable of rotating in the left and right directions around a z1-axis and in the up and down directions around a y1-axis with respect to the main body 14. The active camera 12 can be installed with a gun 16 as shown in FIGS. 5 and 6. In this case, the active camera 12 and the gun 16 are arranged to point the same direction so that they are capable of rotating in the up/down and left/right directions on the main body 14 while tracking a target. The vertical and horizontal rotations of the active camera 12 are made possible by the actuation mechanism 27 having two degrees of freedom.

Preferably, armor 15 is installed on the outer side of the main body 14 to protect the robot 10 from the enemy's bullets or debris. The actuation mechanism having two degrees of freedom as shown in FIGS. 1 through 4 is installed at the gun 16 to control the shooting of the gun 16.

The sentry robot 10 may further include a control portion (not shown). The control portion receives an image from the master camera 11 and the active camera 12, recognizes the received image, and controls the operations of the master camera 11, the active camera 12, and a driving portion 17. The control portion may be installed inside the main body 14.

As described above, according to the actuation mechanism having two degrees of freedom according to the present invention, the gun or camera can accurately move and point while tracking a target. Also, the sentry robot having the actuation mechanism can recognize as an image the shape and movement of the target located at a short or long distance. Also, the target moving at short and long distances can be effectively tracked, and automatic shooting at the target is possible. In particular, tracking of a target in a wider area is possible compared to the conventional sentry robot.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A sentry robot comprising: a base; a main body disposed on the base and capable of pivoting; a master camera disposed on the main body and capable of moving with the motion of the main body;

an actuation mechanism having two degrees of freedom of movement comprising:

a pivot driving portion, which comprises: a platform;

a first connection portion rotatably installed on the platform; and a first motor which rotates the first connection portion; and a vertical driving portion, which comprises:

a second connection portion connected to an upper side of the first connection portion;

a column disposed on the second connection portion; a mount rotatably disposed adjacent an upper portion of the column; and a second motor rotating the mount, with respect to the column, at least partially around a first y-axis, wherein the vertical driving portion is at least partially rotated around a first z-axis when the first motor rotates the first connection portion; and an active camera disposed on the actuation mechanism and capable of moving with the motion of the actuation mechanism to at least partially rotate around the first z-axis and to at least partially rotate around the first y-axis, wherein the master camera is capable of rotating around a second y-axis.

2. The sentry robot of claim 1, wherein the master camera comprises two cameras.

3. The sentry robot of claim 1, further comprising a gun disposed on the actuation mechanism and oriented to point in the same direction as the active camera points and capable of moving with the active camera while tracking a target.

4. The sentry robot of claim 1, wherein the main body rotates around the first z-axis.

5. The sentry robot of claim 1, wherein the master camera has a wider viewing angle than the active camera.

6. The sentry robot of claim 1, wherein the master camera has a zoom function.

7. The sentry robot of claim 1, wherein the master camera and the active camera have an infrared block filter that blocks input of an image in an infrared area.

8. The sentry robot of claim 1, wherein the column has a bend that offsets the column in a horizontal direction from bottom to top.

9. The sentry robot of claim 1, wherein the column is bent in a rearward direction.

10. The sentry robot of claim 3, further comprising gun armor disposed adjacent to the gun.

11. The sentry robot of claim 3, wherein:

the column has a bend that offsets the column in a horizontal direction from bottom to top;

the column has a mounting point for the gun that is not directly above a center of rotation of the first connection portion; and the gun has a center of gravity that is generally directly above the center of rotation of the first connection portion.

12. The sentry robot of claim 6, wherein the active camera has a higher resolution than the master camera.

13. The sentry robot of claim 7, wherein the master camera and the active camera can receive a color image when the infrared block filter is in an on state and a black and white image when the infrared block filter is in an off state.

14. The sentry robot of claim 10, wherein the armor substantially surrounds at least three sides of the entire gun and moves with the gun.

15. The sentry robot of claim 10, wherein the armor surrounds at least four sides of rotation points of the first connection portion and the second rotation portion.

16. A sentry robot comprising:

an actuation mechanism disposed on a main body, the actuation mechanism comprising: a pivot driving portion, which comprises: a first connection portion rotatably installed on a platform; and a first motor which drives the first connection portion; and a vertical driving portion, which comprises: a second connection portion coupled to the first connection portion that is rotated by drive forces received from the first connection portion; a column disposed on the second connection portion; a mount rotatably disposed adjacent an upper portion of the column; and a second motor that rotates the mount, with respect to the column, at least partially around a first y-axis, wherein the vertical driving portion is at least partially rotated around a first z-axis when the first motor rotates the first connection portion; a base upon which the main body is rotatably coupled, wherein the main body rotates at least partially around the first z-axis; a master camera capable of moving with the motion of the main body; and an active camera disposed on the mount of the actuation mechanism and capable of moving with the motion of the actuation mechanism to at least partially rotate around the first z-axis and capable of moving with the motion of the mount to at least partially rotate around the first y-axis;

wherein the master camera is capable of rotating around a second y-axis.

17. The sentry robot of claim 16, wherein the master camera has a wider viewing angle than the active camera.

18. The sentry robot of claim 16, wherein the column is bent in a rearward direction.

19. The sentry robot of claim 17, wherein the master camera has a zoom function.

20. The sentry robot of claim 17, wherein the active camera has a higher resolution than the master camera.

21. The sentry robot of claim 17, further comprising a gun disposed adjacent to the mount and oriented to point in the same direction as the active camera points and capable of moving with the active camera while tracking a target.

22. A sentry robot comprising:

an actuation mechanism disposed on a main body, the actuation mechanism comprising:

a pivot driving portion, which comprises:

a platform;

a first connection portion rotatably installed on the platform; and a first motor which drives the first connection portion; and a vertical driving portion, which comprises:

a second connection portion coupled to the first connection portion that is rotated by drive forces received from the first connection portion;

a column disposed on the second connection portion;

a mount rotatably disposed on the column; and a second motor that rotates the mount, with respect to the column, at least partially around a first y-axis, wherein the vertical driving portion is at least partially rotated around a first z-axis when the first motor rotates the first connection portion;

a base upon which the main body is rotatably disposed, wherein the main body rotates at least partially around the first z-axis;

a master camera coupled to the main body and capable of moving with the motion of the main body, and also capable of at least partially rotating around a second z-axis, and of at least partially rotating around a second y-axis; and an active camera disposed on the actuation mechanism mount and capable of moving with the motion of the actuation mechanism to at least partially rotate around the first z-axis and capable of moving with the motion of the mount to at least partially rotate around the first y-axis.

23. The sentry robot of claim 22, wherein the master camera has a zoom function and has a wider viewing angle than the active camera, and the active camera has a higher resolution than the master camera.

24. The sentry robot of claim 22, wherein the column is bent in a rearward direction.

* * * * *